US010515789B2

(12) United States Patent
Guckenberger et al.

(10) Patent No.: US 10,515,789 B2
(45) Date of Patent: Dec. 24, 2019

(54) REDUCING DETECTOR WEAR DURING CALIBRATION AND TUNING

(71) Applicant: Thermo Finnigan LLC, San Jose, CA (US)

(72) Inventors: George B. Guckenberger, Austin, TX (US); Scott T. Quarmby, Round Rock, TX (US); John G. Voss, Round Rock, TX (US); Michael B. Young, Austin, TX (US)

(73) Assignee: THERMO FINNIGAN LLC, San Jose, CA (US)

( * ) Notice: Subject to any disclaimer, the term of this patent is extended or adjusted under 35 U.S.C. 154(b) by 122 days.

(21) Appl. No.: 15/920,233

(22) Filed: Mar. 13, 2018

(65) Prior Publication Data

US 2018/0286647 A1 Oct. 4, 2018

Related U.S. Application Data

(60) Provisional application No. 62/477,964, filed on Mar. 28, 2017.

(51) Int. Cl.

| | |
|---|---|
| ***H01J 49/00*** | (2006.01) |
| ***H01J 49/02*** | (2006.01) |
| ***H01J 49/14*** | (2006.01) |
| *H01J 49/06* | (2006.01) |
| *H01J 49/42* | (2006.01) |

(52) U.S. Cl.

CPC ..... *H01J 49/0009* (2013.01); *H01J 49/025* (2013.01); *H01J 49/147* (2013.01); *H01J 49/06* (2013.01); *H01J 49/4205* (2013.01)

(58) Field of Classification Search

USPC ..... 250/252.1

See application file for complete search history.

(56) References Cited

U.S. PATENT DOCUMENTS

| | | | |
|---|---|---|---|
| 7,047,144 | B2 | 5/2006 | Steiner |
| 7,323,682 | B2 | 1/2008 | McCauley et al. |
| 9,035,244 | B2 | 5/2015 | Rafferty et al. |

(Continued)

FOREIGN PATENT DOCUMENTS

| | | | |
|---|---|---|---|
| EP | 1365437 | A2 | 11/2003 |
| EP | 2819144 | A2 | 12/2014 |
| GB | 2537148 | A | 10/2016 |

OTHER PUBLICATIONS

Oberacher et al., "Effect of instrument tuning on the detectabilityof biopolymers in electrospray ionization mass spectrometry", J. Mass Spectrom. 2003 (38), pp. 108-116.

(Continued)

*Primary Examiner* — Kiet T Nguyen

(74) *Attorney, Agent, or Firm* — David A. Schell

(57) ABSTRACT

A method of operating a mass spectrometer comprising: detecting a first ion species using a first gain setting of a detector or a first emission current for a first mass-to-charge range; detecting a second ion species using a second gain setting of the detector or a second emission current for a second mass-to-charge range; and using the detected first and second ion species to calibrate the mass range of a mass analyzer of the mass spectrometer, to tune the resolution of the mass analyzer, or to tune an ion optic of the mass spectrometer.

19 Claims, 7 Drawing Sheets

(56) References Cited

U.S. PATENT DOCUMENTS

| | | | | |
|---|---|---|---|---|
| 10,056,244 | B1 * | 8/2018 | Quarmby | H01J 49/429 |
| 10,199,207 | B1 * | 2/2019 | Eiler | H01J 49/4265 |
| 2005/0080571 | A1 | 4/2005 | Klee | |
| 2009/0108191 | A1 | 4/2009 | Yefchak et al. | |
| 2009/0194681 | A1 | 8/2009 | McCauley | |
| 2018/0012740 | A1 * | 1/2018 | Shimomura | G01N 27/62 |

OTHER PUBLICATIONS

Ramakumar et al., "Calibration procedures for a multicollector mass spectrometer for cup efficiency, detector amplifier linearity, and isotope fractionation to evaluate the accuracy in the total evaporation method", International Journal of Mass Spectrometry 184 (1999), pp. 109-118.

Wong et al., "Sub Part-Per-Million Mass Accuracy by Using Stepwise-External Calibration in Fourier Transform Ion Cyclotron Resonance Mass Spectrometry", J Am Soc Mass Spectrom 2006, 17, pp. 1681-1691.

* cited by examiner

REDUCING DETECTOR WEAR DURING CALIBRATION AND TUNING

FIELD

The present disclosure generally relates to the field of mass spectrometry including reducing detector wear during calibration and tuning.

INTRODUCTION

Mass spectrometry can be used to perform detailed analyses on samples. Furthermore, mass spectrometry can provide both qualitative (is compound X present in the sample) and quantitative (how much of compound X is present in the sample) data for a large number of compounds in a sample. These capabilities have been used for a wide variety of analyses, such as to test for drug use, determine pesticide residues in food, monitor water quality, and the like.

Sensitivity of a mass spectrometer can be limited by the efficiency of the ion source, ion losses through the mass spectrometer and in the mass analyzer, and sensitivity of the detector. Increasing the efficiency of the ion source, the number of ions produced per unit sample or per unit time, can significantly improve the detection limits of the mass spectrometer, enabling the detection of lower concentrations of compounds or the use of smaller amounts of sample. However, increasing the number of ions produced per unit time can have the deleterious effect of reducing electron multiplier lifetime. As such, there is a need for improved ion sources.

SUMMARY

In a first aspect, a method of operating a mass spectrometer can include detecting a first ion species using a first gain setting of a detector or a first emission current for a first mass-to-charge range; detecting a second ion species using a second gain setting of the detector or a second emission current for a second mass-to-charge range; and using the detected first and second ion species to calibrate the mass range of a mass analyzer of the mass spectrometer, to tune the resolution of the mass analyzer, or to tune an ion optic of the mass spectrometer.

In various embodiments of the first aspect, the method can further include ionizing a calibration mixture including one or more calibrant species in an ion source to generate the first and second ion species. In particular embodiments, the method can further include supplying the calibration mixture through a sample inlet into the ionization chamber, and accelerating electrons from an electron emitter through the ionization chamber along a source axis.

In various embodiments of the first aspect, the mass analyzer can be a mass filter, an ion trap, or any combination thereof.

In various embodiments of the first aspect, the first ion species can have a higher abundance than the second ion species and the first gain setting can be lower than the second gain setting to avoid oversaturation of the detector during detecting the first ion species. In particular embodiments, the second ion species can be a low abundance ion species and the second gain setting can be higher than the first gain setting to ensure sufficient signal to detect the second species.

In a second aspect, a mass spectrometer can include an ion source, ion optic elements configured to guide ions along an ion path; a mass analyzer configured to separate ions based on a mass to charge ratio of the ions; a detector; and a system controller. The ion source can include a body comprising an ionization chamber at a first end, a sample inlet into the ionization chamber, and a post ionization volume at a second end, the body having a length along a source axis from the first end to the second end and an electron source positioned at the first end, the electron source including an electron emitter and configured for accelerating an electron beam through the ionization chamber. The system controller can be configured to apply an ion specific detector gain during a mass calibration of the mass analyzer, during a resolution tune of the mass analyzer, or during a tune of an ion optics element to avoid oversaturation of the detector for high abundance ions and obtain sufficient signal for low abundance ions.

In various embodiments of the second aspect, the electron beam can be accelerated through the ionization chamber along the source axis.

In various embodiments of the second aspect, the electron source can be a thermionic filament or a field emitter.

In various embodiments of the second aspect, the mass analyzer can be a mass filter, an ion trap, or any combination thereof.

In various embodiments of the second aspect, the high abundance ions and the low abundance ions can be produced by ionizing a calibration mixture including one or more calibrant species.

In various embodiments of the second aspect, the system controller can be further configured to reduce the emission current during a detector gain calibration such that single ion events dominate the signal or Poisson statistics dominate the root mean square deviation. In particular embodiments, the system controller can be configured to reduce the emission current by reducing the current supplied to the electron source.

In a third aspect, a method of operating a mass spectrometer can include applying an ion specific gain during a mass calibration of a mass analyzer, during a resolution tune of the mass analyzer, or during a tune of an ion optics element to avoid oversaturation of the detector for high abundance ions and obtain sufficient signal for low abundance ions.

In various embodiments of the third aspect, the mass analyzer can be a mass filter, an ion trap, or any combination thereof.

In various embodiments of the third aspect, the high abundance ions and the low abundance ions can be produced by ionizing a calibration mixture including one or more calibrant species.

In various embodiments of the third aspect, the method further includes performing a detector gain calibration with a reduced emission current such that single ion events dominate the signal or Poisson statistics dominate the root mean square deviation. In particular embodiments, the emission current can be reduced by reducing the current supplied to an electron source.

In various embodiments of the third aspect, wherein the electron source can be a thermionic filament or a field emitter.

DRAWINGS

For a more complete understanding of the principles disclosed herein, and the advantages thereof, reference is now made to the following descriptions taken in conjunction with the accompanying drawings and exhibits, in which.

Figure 1:
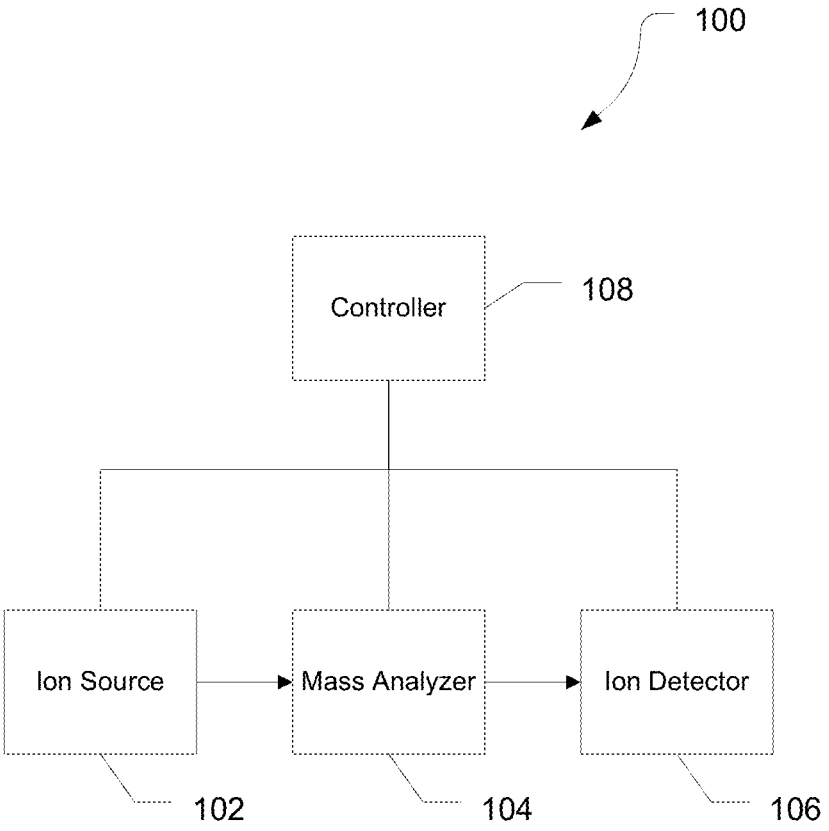
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion isolation are described herein and in the accompanying exhibits.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a quadrupole ion trap analyzer, a time-of-flight (TOF) analyzer, an electrostatic trap (e.g., ORBITRAP) mass analyzer, Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Ion Source

Figure 2A:
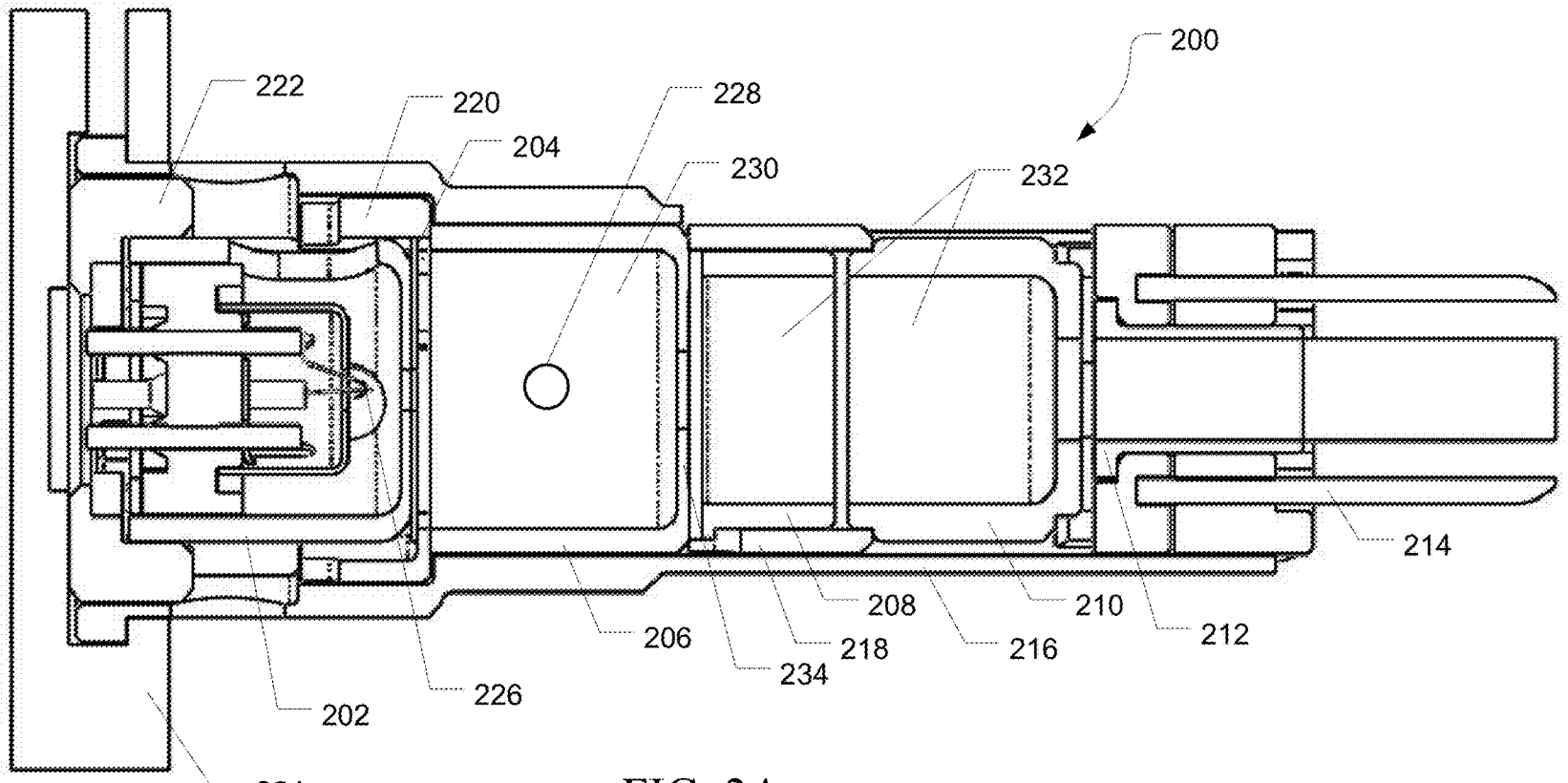
FIGS. 2A and 2B are diagrams illustrating an exemplary ion source, in accordance with various embodiments.
Figure 2B:
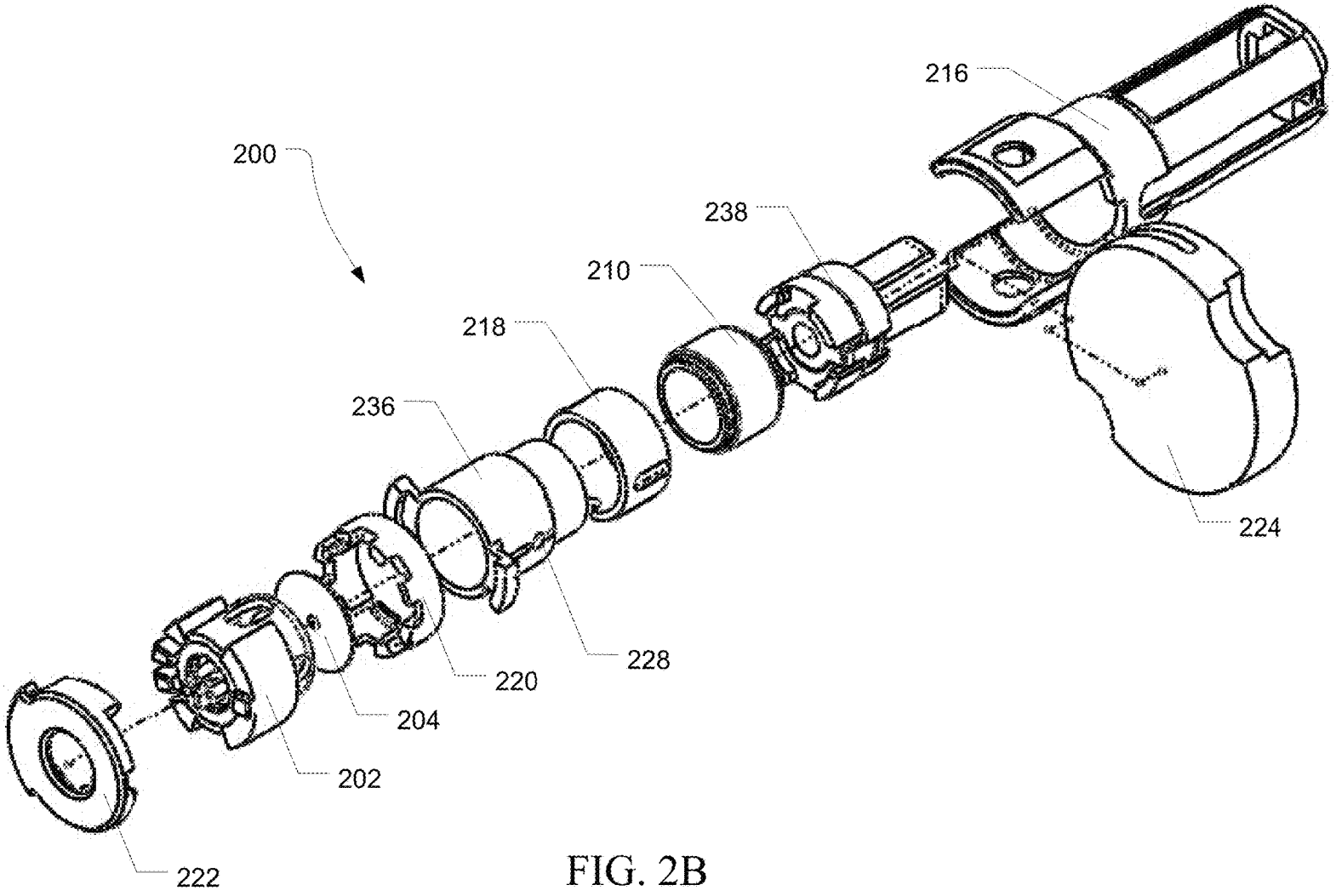

FIGS. 2A and 2B are diagrams illustrating an ion source 200, which can be used as ion source 102 of mass spectrometry platform 100. Ion source 200 can include an electron source 202, an electron lens 204, an ionization chamber 206, lens elements 208, 210, and 212, and RF ion guide 214. Additionally, ion source 200 can include a body 216, insulator 218, spacers 220 and 222, and retaining clip 224.

Electron source 202 can include a thermionic filament 226 for the generation of electrons. In various embodiments, electron source 202 can include more additional thermionic filaments for redundancy or increased electron production. In alternate embodiments, electron source 202 can include a field emitter. The electrons can travel axially along ion source 200 into ionization chamber 206 to ionize gas molecules. Electron lens 204 can serve to prevent the ions from traveling back towards the electron source.

Ionization chamber 206 can include gas inlet 228 for directing a gas sample into an ionization volume 230 defined by the ionization chamber 206. Gas molecules within the ionization volume 230 can be ionized by the electrons from the thermionic filament 226. Lenses 208 and 210 can define a post ionization volume 232. Post ionization volume 232 can be a region where ions can be formed which has a lower pressure for the sample. Post ionization volume 232 can include regions of the lenses where electrons are present. In various embodiments, it may also include areas outside of the ionization volume and the lenses. Wall 234 can restrict the flow of gas from ionization volume 230 to the post ionization volume 232, creating a substantial pressure difference between the ionization volume 230 and post ionization volume 232. While ionization can occur in post ionization volume 232, significantly more ions can be generated in ionization volume 230 due to the lower sample density in the post ionization volume 232.

In various embodiments, the ionization chamber 206 and lens element 208 can be joined to create an extended ionization element 236 defining the ionization volume 230 and at least a portion of the post ionization volume 232. In such embodiments, lens element 208 can be electrically coupled to ionization chamber 206. In other embodiments, the joined ionization chamber 206 and lens element 208 can be electrically isolated, such that different voltage potentials can be applied to the ionization chamber 206 and the lens element 208.

Lens 210 and 212 and RF ion guide 214 can assist in the axial movement of ions from the ionization volume 230 to additional ion optical elements and mass analyzer 104 of mass spectrometry platform 100. In various embodiments, ion guide assembly 238 can include lens 212 and RF ion guide 214. Ion guide assembly 238 can include additional insulating portions to electrically isolate lens 212 from RF ion guide 214. Additionally, the insulating portions can include standoffs to prevent electrical contact between lens 210 and lens 212.

When assembled into body 216, insulator 218 can prevent electrical contact between lens 208 (or extended ionization element 236) and lens 210. Spacers 220 can prevent electrical contact between electron lens 204 and ionization chamber 208 (or extended ionization element 236). Spacer 222 can be indexed to prevent rotation of the electron source 202, and retaining clip 224 can hold the other components within body 216.

Figure 3:
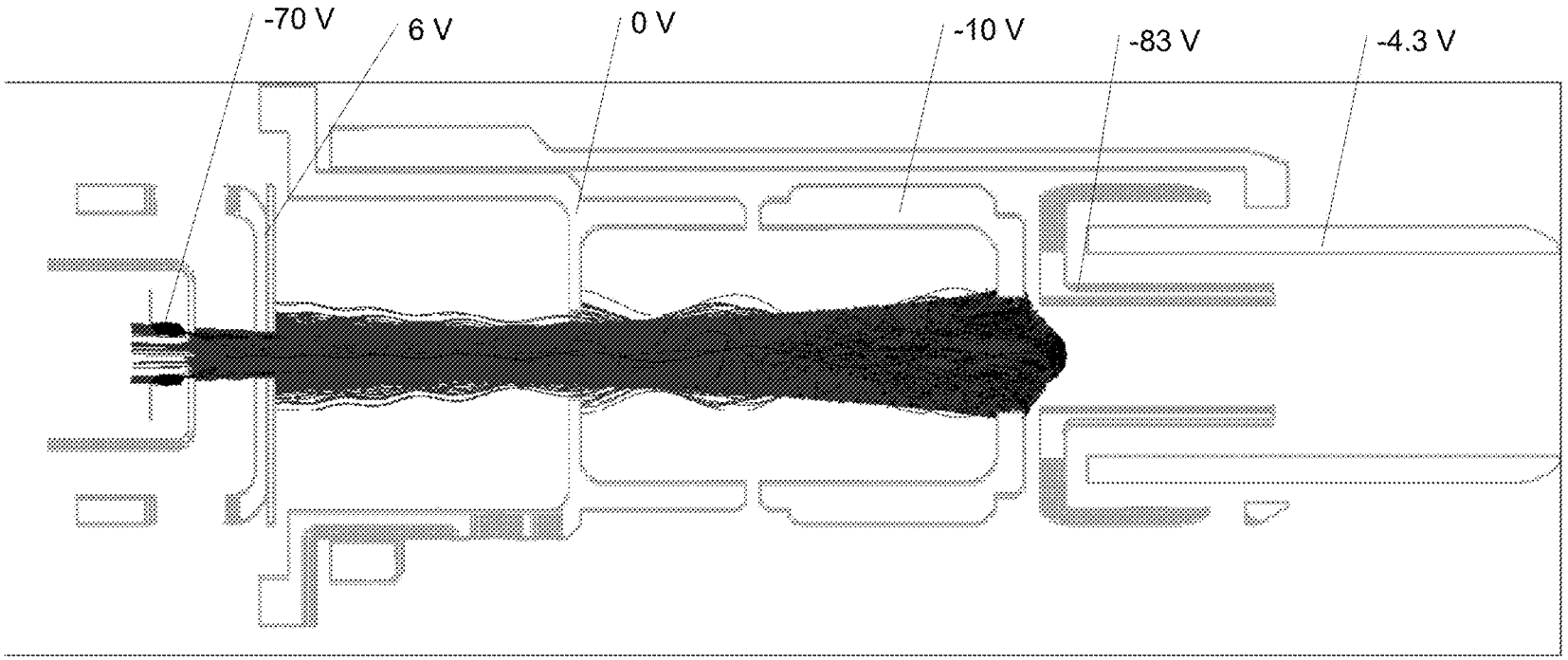
FIG. 3 is a diagram illustrating a simulation of electrons in an ion source, in accordance with various embodiments.

FIG. 3 is an illustration of a simulation of electrons in ion source 200 with forced electrostatic reflection of the electrons. The electrons can be electrostatically reflected by lens element 212 when the lens potential is sufficiently more negative on its axis than the electron energy of the electrons produced in the electron source 202. Potentials used for the simulation are shown in FIG. 3 and Table 1. In various embodiments, filament 226 can have a potential of between about −40 V and −80 V, such as about −45 V, and electron lens 204 can have a potential between about 0 V to about 15 V, such as between about 5 V and about 7 V. Ionization chamber 206 and lens element 208 can be grounded (about 0 V), and lens element 210 can have a potential of between about 0 V and about −15 V, such as between about −2 V and about −10 V. Lens element 212 can have a potential of between about −50 V and about −150 V, and RF ion guide 214 can have an offset voltage of about −15 V to about 1 V. In other embodiments, filament 226 can have a potential of about −70 V and lens element 212 can have a potential of between about −83 V and about −150 V.

TABLE 1

| Electrostatic Reflection | | | |
|---|---|---|---|
| | Simulation | Alternative 1 | Alternative 2 |
| Filament 226 | −70 V | −45 V | −70 V |
| Electron Lens 204 | 6 V | 0 V to 15 V | 0 V to 15 V |
| Ionization Chamber 206 | 0 V (grounded) | 0 V (grounded) | 0 V (grounded) |
| Lens 208 | 0 V (grounded) | 0 V (grounded) | 0 V (grounded) |
| Lens 210 | −10 V | 0 V to −15 V | 0 V to −15 V |
| Lens 212 | −83 V | −50 V to −150 V | −83 V to −150 V |
| RF Ion Guide 214 | −4.3 V | −15 V to 1 V | −15 V to 1 V |

Tuning

Figure 4:
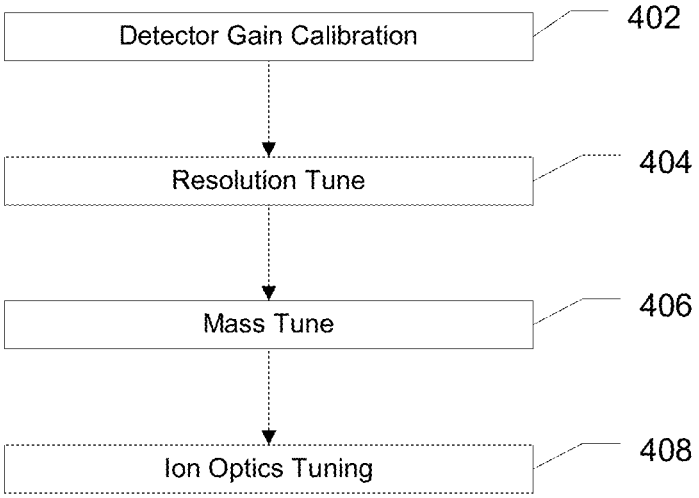
FIG. 4-7 are flow diagrams illustrating exemplary methods for tuning various components of a mass spectrometry system, in accordance with various embodiments.

Performance and sensitivity of the mass spectrometer platform can depend on the settings of various components of the mass spectrometer platform, such as detector gain, lens voltages, RF amplitudes of quadrupoles/ion traps, and differential DC voltage of quadrupoles. Typically, the mass spectrometer platform can undergo a tuning process to determine these settings. FIG. 4 is flow diagram illustrating an exemplary method of tuning the mass spectrometer platform. At 402, the detector gain can be calibrated. In various embodiments, the detector gain calibration can include measuring the detector output (intensity) at various detector voltages and calibrating a gain curve. In various embodiments, the emission current can be reduced until single ion events dominate. Alternatively, the emission current can be reduced such that the variability in detection events are dominated by Poisson type probability distribution, such as, for example, according to the approach to measuring the gain of an electron multiplier has been described by Fies (International Journal of Mass Spectrometry and Ion Proceedings, 82 (1988) pp. 111-129 (incorporated herein by reference)). Then the detector can be set to the voltage necessary to achieve a desired gain.

At 404, a resolution tune can be performed. In various embodiments, the resolution tune can include measuring the intensity and assessing peak shape while adjusting the differential DC (U) of a quadrupole. The data can be fit to determine an optimal differential DC and can differential DC can be set to the optimal value. In various embodiments, a resolution tune can be performed for multiple quadrupoles in the mass spectrometry system.

At 406, a mass tune can be performed. In various embodiments, the mass tune can include monitoring the mass position of known calibrant ions as the quadrupole is scanned across a mass range. In various embodiments, the calibrant ions can be produced by ionizing a calibration mixture including one or more calibrant species. In particular embodiments, a single calibrant species can give rise to multiple calibrant ion species having different mass-to-charge ratios. A calibration curve can be determined and used for determining the mass-to-charge ratio of ions in a sample. In various embodiments, a mass tune can be performed for multiple quadrupoles in the mass spectrometry system.

At 408, ion optics can be tuned. The tuning of the ion optics can include determining potentials for various lenses and determining a DC offset for one or more quadrupoles. In various embodiments, the ion optics can be tuned by monitoring the intensity and optionally monitoring peak shape as the voltage of the ion optics component is adjusted. The data can be fit to determine an optimal voltage for the ion optics component and the voltage can be set to the optimal value. In various embodiments, the ion optics components can be tuned individually, and two or more components can be tuned iteratively to account for dependencies. Alternatively, two or more ion optics components can be tuned simultaneously using various known multivariable optimization methods.

Tuning of a mass spectrometry system with a high intensity source can have an impact on detector lifetime as a significant number of ions can impact the detector during tuning. The impact of tuning on the detector can be reduced and the life of the detector can be extended by adjusting emission current or detector gain during the tuning process or by adjusting the amount of ions formed. In various embodiments, the amount of ions formed can be reduced by reducing the amount of electron reflection or reducing the number of electrons entering the ionization volume. Various techniques are known in the art for controlling the number of electrons entering the ionization volume, such as described in U.S. Pat. No. 7,323,682 filed Mar. 15, 2005 incorporated by reference. For example, the electrons can be regulated by applying a potential to a lens element of the ion source or between the ion source and the ionization chamber to block the electrons for short periods of time.

Figure 5:
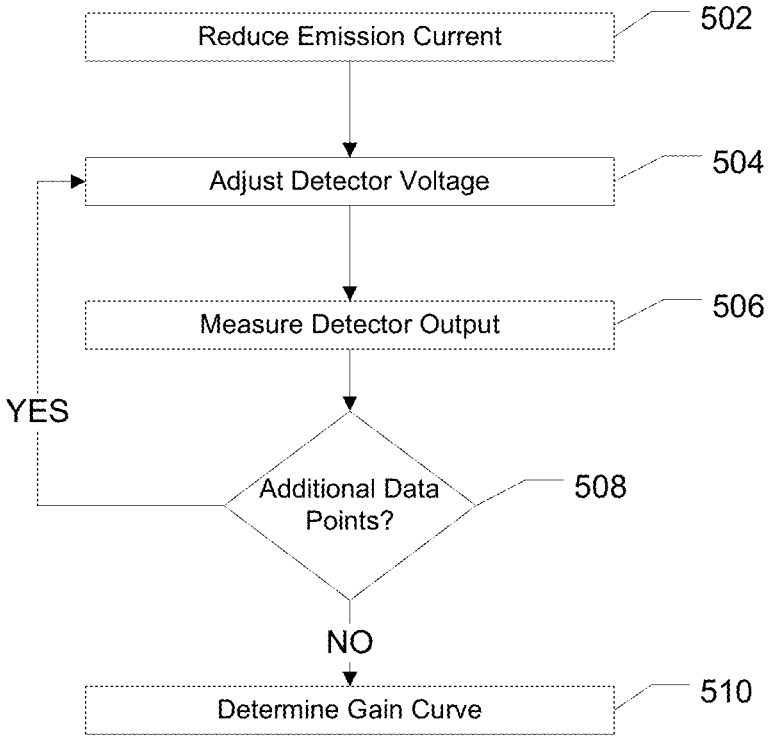
Figure 6:
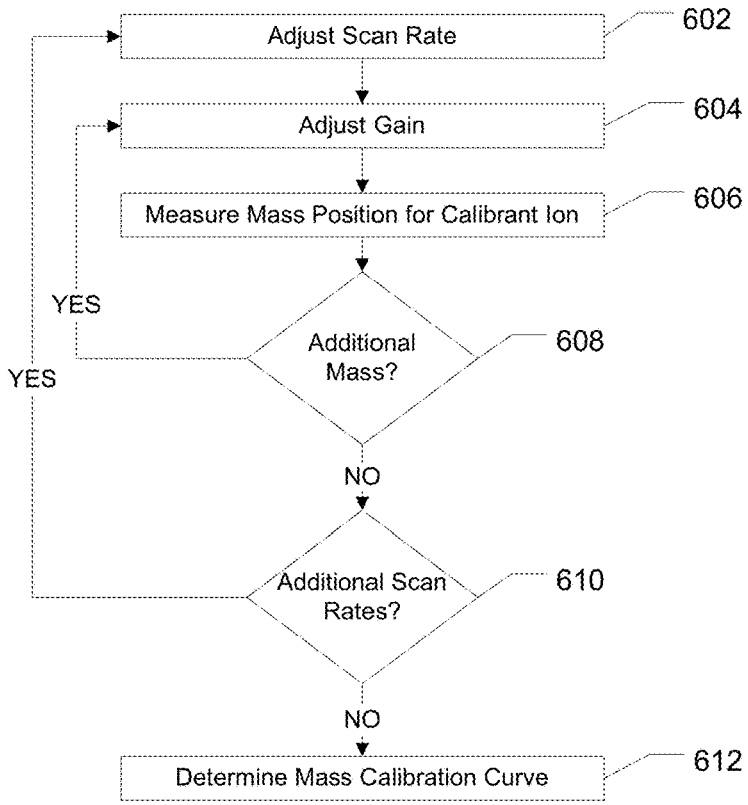
Figure 7:
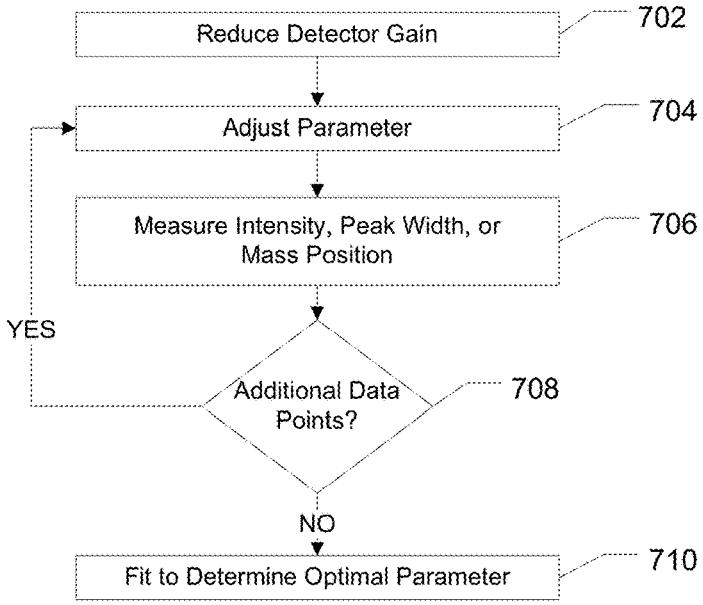

FIGS. 5, 6, and 7 illustrate various methods of reducing degradation of the detector during tuning. FIG. 5 illustrates of method of determining detector gain. At 502, the emission current can be reduced, such as by reducing the current supplied to the thermionic filament or field emitter. The emission current can be reduced until Poisson effects dominate the root mean square distribution, such as in the method described by Fies (International Journal of Mass Spectrometry and Ion Proceedings, 82 (1988) pp. 111-129. Alternatively, the emission current can be reduced until single ion events dominate the detected events and gain can be calculated on a per ion basis. At 504, the detector voltage can be adjusted, and at 506, the detector output can be determined. At 508, it can be determined if additional data points are needed. When additional data points are needed, the detector voltage can be adjusted at 504, and at 506, the detector output at the new detector voltage can be determined. When no additional data points are needed, a gain curve can be determined, as indicated at 510.

FIG. 6 illustrates a method of performing a mass calibration. At 602, the scan rate can be adjusted, and at 604 the gain can be adjusted. In various embodiments, a calibration mix can include ions at different intensities. High intensity calibrant ions can overload the detector at high gain whereas low intensity calibrant ions may not be detectable at low gain. The gain can be adjusted according to the relative abundance of the ions produced by the calibrant mix. At 606, the mass position for a calibrant ion can be determined. At 608, it can be determined if calibrant ions need to be measured. When additional calibrant ion measurements are needed, the gain can be adjusted at 604 for the next calibrant ion, and at 606, the mass position for a calibrant ion can be determined.

At 610, when no additional calibrant ions need to be measured, it can be determined if additional scan rates need to be measured. When additional scan rates are needed, the scan rate can be adjusted at 602. When no additional scan rates are needed, a mass calibration curve can be determined, as indicated at 612.

FIG. 7 illustrates of method of tuning an ion optics additional parameters, such as ion optics components, resolution, and the like. At 702, the detector gain can be reduced or increased, such as depending on the intensity of the calibrant ions. At 704, the parameter to be tuned can be adjusted. The parameter can be a differential DC of a quadrupole, a DC offset of a quadrupole, a lens potential, or the like. At 706, one or more of the intensity, peak width, and mass position can be determined. At 708, it can be determined if additional data points are needed. When additional data points are needed, the parameter can be adjusted at 704. When no additional data points are needed, data can be fit to determine an optimal value for the parameter, as indicated at 710.

Computer-Implemented System

Figure 8:
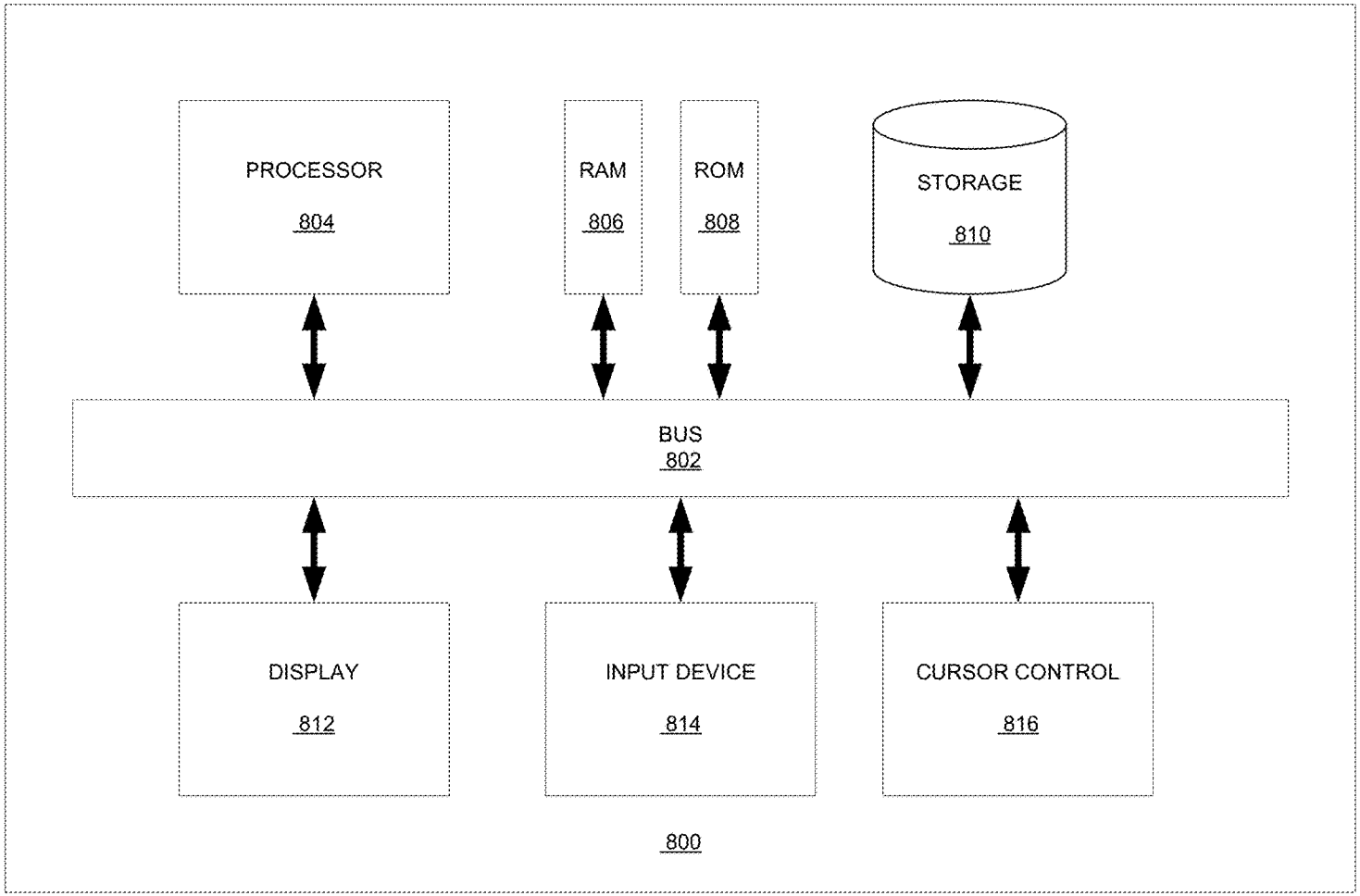
FIG. 8 is a block diagram illustrating an exemplary computer system.

FIG. 8 is a block diagram that illustrates a computer system 800, upon which embodiments of the present teachings may be implemented as which may incorporate or communicate with a system controller, for example controller 810 shown in FIG. 1, such that the operation of components of the associated mass spectrometer may be adjusted in accordance with calculations or determinations made by computer system 800. In various embodiments, computer system 800 can include a bus 802 or other communication mechanism for communicating information, and a processor 804 coupled with bus 802 for processing information. In various embodiments, computer system 800 can also include a memory 806, which can be a random access memory (RAM) or other dynamic storage device, coupled to bus 802, and instructions to be executed by processor 804. Memory 806 also can be used for storing temporary variables or other intermediate information during execution of instructions to be executed by processor 804. In various embodiments, computer system 800 can further include a read only memory (ROM) 808 or other static storage device coupled to bus 802 for storing static information and instructions for processor 804. A storage device 810, such as a magnetic disk or optical disk, can be provided and coupled to bus 802 for storing information and instructions.

In various embodiments, computer system 800 can be coupled via bus 802 to a display 812, such as a cathode ray tube (CRT) or liquid crystal display (LCD), for displaying information to a computer user. An input device 814, including alphanumeric and other keys, can be coupled to bus 802 for communicating information and command selections to processor 804. Another type of user input device is a cursor control 816, such as a mouse, a trackball or cursor direction keys for communicating direction information and command selections to processor 804 and for controlling cursor movement on display 812. This input device typically has two degrees of freedom in two axes, a first axis (i.e., x) and a second axis (i.e., y), that allows the device to specify positions in a plane.

A computer system 800 can perform the present teachings. Consistent with certain implementations of the present teachings, results can be provided by computer system 800 in response to processor 804 executing one or more sequences of one or more instructions contained in memory 806. Such instructions can be read into memory 806 from another computer-readable medium, such as storage device 810. Execution of the sequences of instructions contained in memory 806 can cause processor 804 to perform the processes described herein. In various embodiments, instructions in the memory can sequence the use of various combinations of logic gates available within the processor to perform the processes describe herein. Alternatively hardwired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 804 for execution. Such a medium can take many forms, including but not limited to, non-volatile media, volatile media, and transmission media. Examples of non-volatile media can include, but are not limited to, optical or magnetic disks, such as storage device 810. Examples of volatile media can include, but are not limited to, dynamic memory, such as memory 806. Examples of transmission media can include, but are not limited to, coaxial cables, copper wire, and fiber optics, including the wires that comprise bus 802.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

What is claimed is:

1. A method of operating a mass spectrometer comprising:

detecting a first ion species using a first gain setting of a detector or a first emission current for a first mass-to-charge range;

detecting a second ion species using a second gain setting of the detector or a second emission current for a second mass-to-charge range; and using the detected first and second ion species to calibrate the mass range of a mass analyzer of the mass spectrometer, to tune the resolution of the mass analyzer, or to tune an ion optic of the mass spectrometer.

2. The method of claim 1 further comprising ionizing a calibration mixture including one or more calibrant species in an ion source to generate the first and second ion species.

3. The method of claim 2 further comprising supplying the calibration mixture through a sample inlet into an ionization chamber, and accelerating electrons from an electron emitter through the ionization chamber along a source axis.

4. The method of claim 1 wherein the mass analyzer is a mass filter, an ion trap, or any combination thereof.

5. The method of claim 1 wherein the first ion species has a higher abundance than the second ion species and the first gain setting is lower than the second gain setting to avoid oversaturation of the detector during detecting the first ion species.

6. The method of claim 5 wherein the second ion species is a low abundance ion species and the second gain setting is higher than the first gain setting to ensure sufficient signal to detect the second species.

7. A mass spectrometer comprising:

an ion source comprising:

a body comprising an ionization chamber at a first end, a sample inlet into the ionization chamber, and a post ionization volume at a second end, the body having a length along a source axis from the first end to the second end; and an electron source positioned at the first end, the electron source including an electron emitter and configured for accelerating an electron beam through the ionization chamber;

ion optic elements configured to guide ions along an ion path;

a mass analyzer configured to separate ions based on a mass to charge ratio of the ions;

a detector;

a system controller configured to:

apply an ion specific detector gain during a mass calibration of the mass analyzer, during a resolution tune of the mass analyzer, or during a tune of an ion optics element to avoid oversaturation of the detector for high abundance ions and obtain sufficient signal for low abundance ions.

8. The mass spectrometer of claim 7 wherein the electron beam is accelerated through the ionization chamber along the source axis.

9. The mass spectrometer of claim 7 wherein the electron source is a thermionic filament or a field emitter.

10. The mass spectrometer of claim 7 wherein the mass analyzer is a mass filter, an ion trap, or any combination thereof.

11. The mass spectrometer of claim 7 wherein the high abundance ions and the low abundance ions are produced by ionizing a calibration mixture including one or more calibrant species.

12. The mass spectrometer of claim 7 wherein the system controller is further configured to reduce an emission current during a detector gain calibration such that single ion events dominate the signal or Poisson statistics dominate the root mean square deviation.

13. The mass spectrometer of claim 12 wherein the system controller is configured to reduce the emission current by reducing the current supplied to the electron source.

14. A method of operating a mass spectrometer comprising:

applying an ion specific gain during a mass calibration of a mass analyzer, during a resolution tune of the mass analyzer, or during a tune of an ion optics element to avoid oversaturation of a detector for high abundance ions and obtain sufficient signal for low abundance ions.

15. The method of claim 14 wherein the mass analyzer is a mass filter, an ion trap, or any combination thereof.

16. The method of claim 14 wherein the high abundance ions and the low abundance ions are produced by ionizing a calibration mixture including one or more calibrant species.

17. The method of claim 14 further comprising performing a detector gain calibration with a reduced emission current such that single ion events dominate the signal or Poisson statistics dominate the root mean square deviation.

18. The method of claim 17 wherein the emission current is reduced by reducing the current supplied to an electron source.

19. The method of claim 14 wherein the electron source is a thermionic filament or a field emitter.

* * * * *